US007798877B1

(12) United States Patent
Wortham

(10) Patent No.: US 7,798,877 B1
(45) Date of Patent: Sep. 21, 2010

(54) SYMMETRY SURFING SYSTEM

(76) Inventor: Ward Hawkins Wortham, 405 W. 26th St., Richmond, VA (US) 23225

( * ) Notice: Subject to any disclaimer, the term of this patent is extended or adjusted under 35 U.S.C. 154(b) by 0 days.

(21) Appl. No.: 12/340,653

(22) Filed: Dec. 20, 2008

Related U.S. Application Data

(63) Continuation of application No. 11/837,936, filed on Aug. 13, 2007, now abandoned, which is a continuation-in-part of application No. 11/278,668, filed on Apr. 4, 2006, now abandoned.

(51) Int. Cl.
*B63B 1/00* (2006.01)

(52) U.S. Cl. ..... 441/79

(58) Field of Classification Search ..... 114/39.18, 114/140, 141; 441/65, 74, 75, 79
See application file for complete search history.

(56) References Cited

U.S. PATENT DOCUMENTS 3,066,327 A 12/1962 Durfey
3,082,444 A 3/1963 Estes
3,455,261 A 7/1969 Perrin
4,107,806 A 8/1978 Newland et al.
4,805,546 A 2/1989 Geller et al.
5,152,705 A 10/1992 Rock
2004/0176000 A1 9/2004 Mann
2006/0046589 A1 3/2006 Farley et al.

FOREIGN PATENT DOCUMENTS

WO 92/00873 A1 1/1992

*Primary Examiner*—Edwin Swinehart

(57) ABSTRACT

A symmetry surfing system enables a surfboard with two ends both of which may be controllably switched between roles of front end and tail end, thus giving the surfboard dual-directional capabilities. A removable fin system may be disposed at the two ends so that when the surfer selectively activates the footplate of the removable fin system, one or more fins extend into the water. The removable fin system may be modular so as to facilitate interchangeability and installation processes. The system may preferably include a harness to be worn by the surfer. A winding reel is attached to the surfer preferably via such a harness worn by the surfer, and winds a centered leash that secures the surfer to the surfboard under tension. The symmetry surfing system maximizes surfboard maneuverability and surfboards' potential for aggressive trick surfing.

20 Claims, 5 Drawing Sheets

FIG. 2
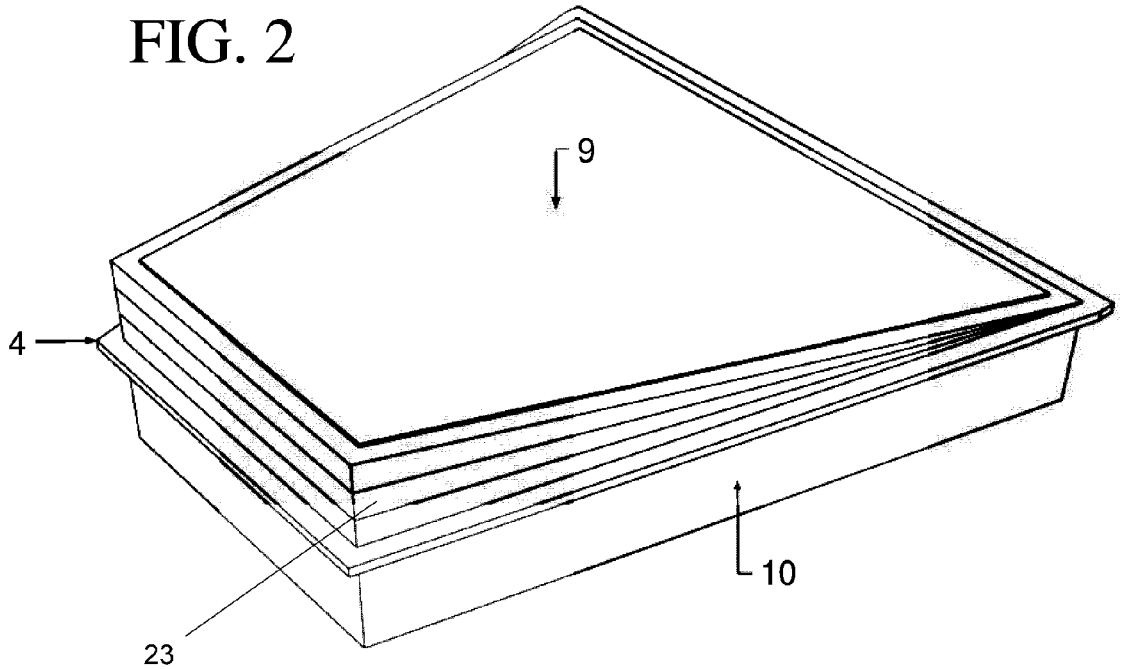
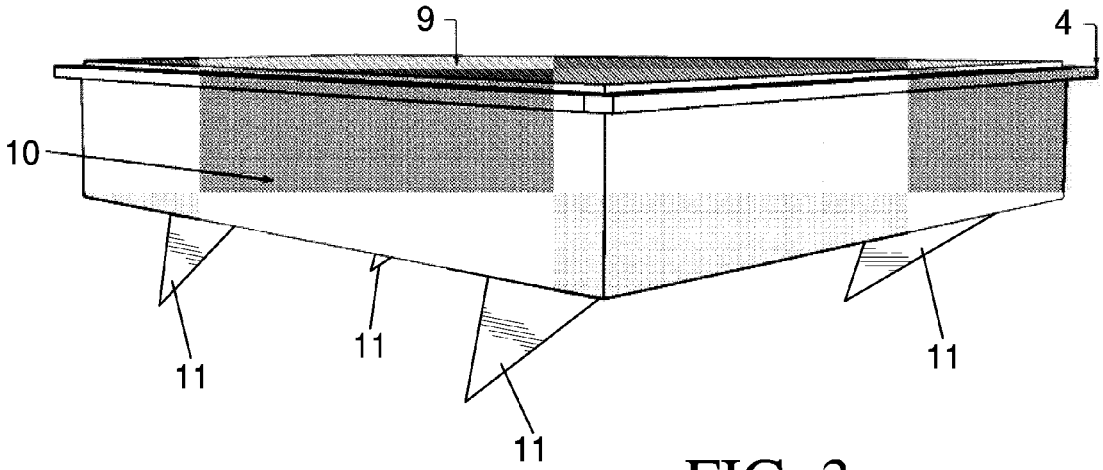
FIG. 3

SYMMETRY SURFING SYSTEM

This application is a Continuation of application Ser. No. 11/837,936 filed on Aug. 13, 2007, now abandoned. Parent application Ser. No. 11/837,936, in turn, is a Continuation-in-Part of application Ser. No. 11/278,668 filed on Apr. 4, 2006, now abandoned; the entirety of parent application Ser. No. 11/837,936 and of parent application Ser. No. 11/278,668 are incorporated herein by reference in their entirety and for all intents and purposes.

BACKGROUND OF THE INVENTION

1. Field of the Invention

The present invention relates to a symmetric surfing system having modifications and improvements necessary to provide capabilities for a new style and method of surfing, a process for creating such a system, and accessory thereto apparatus.

2. Description of Related Art

The sport of surfing has existed for decades. Early surfboards were 'longboards.' By general description longboards were eight feet or longer, or three feet taller than the surfer in overall length. Made originally of wood, longboards provide a vast planing surface that makes them stable in water. Longboards are excellent for novices. In the early 1900's some surfboards were made of plywood and were called 'hollowboards'. Again, these were longboards, typically 15 to 20 feet in length. Foam and fiberglass surfboards became available in the late 1950s and shortboards followed in the late 1960s.

Notably, traditional surfboards are asymmetrical, with their two ends distinctly different, making them useful for travelling in only a single direction unless the surfboard is pivoted entirely around. In such conventional systems, the front end, or nose, is the leading edge and goes forward; and the back end, or tail, is where the fins are permanently fixed in place. Thus, using a standard surfboard with two distinctly different ends, a surfer intent on changing directions must physically turn his surfboard 360-degrees in order to bring the nose of the board around and into the selected path of momentum. A surfer on a standard surfboard must go from a standing to a prone position and then paddle in order to effect such a change.

In the traditional surfing situations referred to above, a leash attached to the surfer typically only provides a way to keep from having to chase a surfboard after losing contact with it. In this regard, a standard surfboard typically has a leash tie at its tail for the purpose of preventing a surfer from losing his surfboard; conventionally, the other end of the leash is looped around a surfer's ankle. Typically, the leash is always slack when the surfer is with the surfboard. However, such a loose, trailing leash may cause frictional drag in the water.

As mentioned above 'shortboards' were developed as surfing evolved. Shortboards are somewhat akin to skateboards in the way they are ridden. The current trend is for shorter, lighter surfboards that permit fast, aggressive 'trick' surfing. It must also be noted that contemporary surfing encompasses both recreation and competition. Competition has made aggressive trick surfing the standard by which many of today's professional surfers are measured.

SUMMARY OF THE INVENTION

The symmetric surfing system aims to extend the limits of surfing, creating a new style of surfing by enabling a board that can easily lead with either end. Symmetric surfing will maximize the potential of a surfboard for aggressive trick surfing by creating a dual-directional surfboard with increased maneuverability, thus allowing for more creative surfing by increasing the number of maneuvers possible quickly. This symmetric surfboard system is designed to increase surfing performance possibilities by maximizing a surfboard's potential maneuverability. The dual-directional capabilities of the symmetric surfing system may require a challenging level of expertise from a surfer, but shall reward that surfer by increasing both the number and kind of tricks that he may perform, either for recreation or for competition.

More details about the symmetric surfing systems, apparatus, and processes according to the present invention will be better comprehended during the following description of versions of the invention. The invention is described in the attached figures, in the sense of non-restrictive examples and without limitation in the range of the applications of the apparatus and method. These and other features, aspects, and advantages of the present invention will become better understood with regard to the following description, appended claims, and accompanying drawings, where:

BRIEF DESCRIPTIONS OF THE DRAWINGS

FIG. 2 is an elevational view of a version of the removable fin system depicting the footplate up and fins retracted.

FIG. 3 is an elevational view of a version of the removable fin system depicting fins in an extended position.

DETAILED DESCRIPTION

Figure 1:
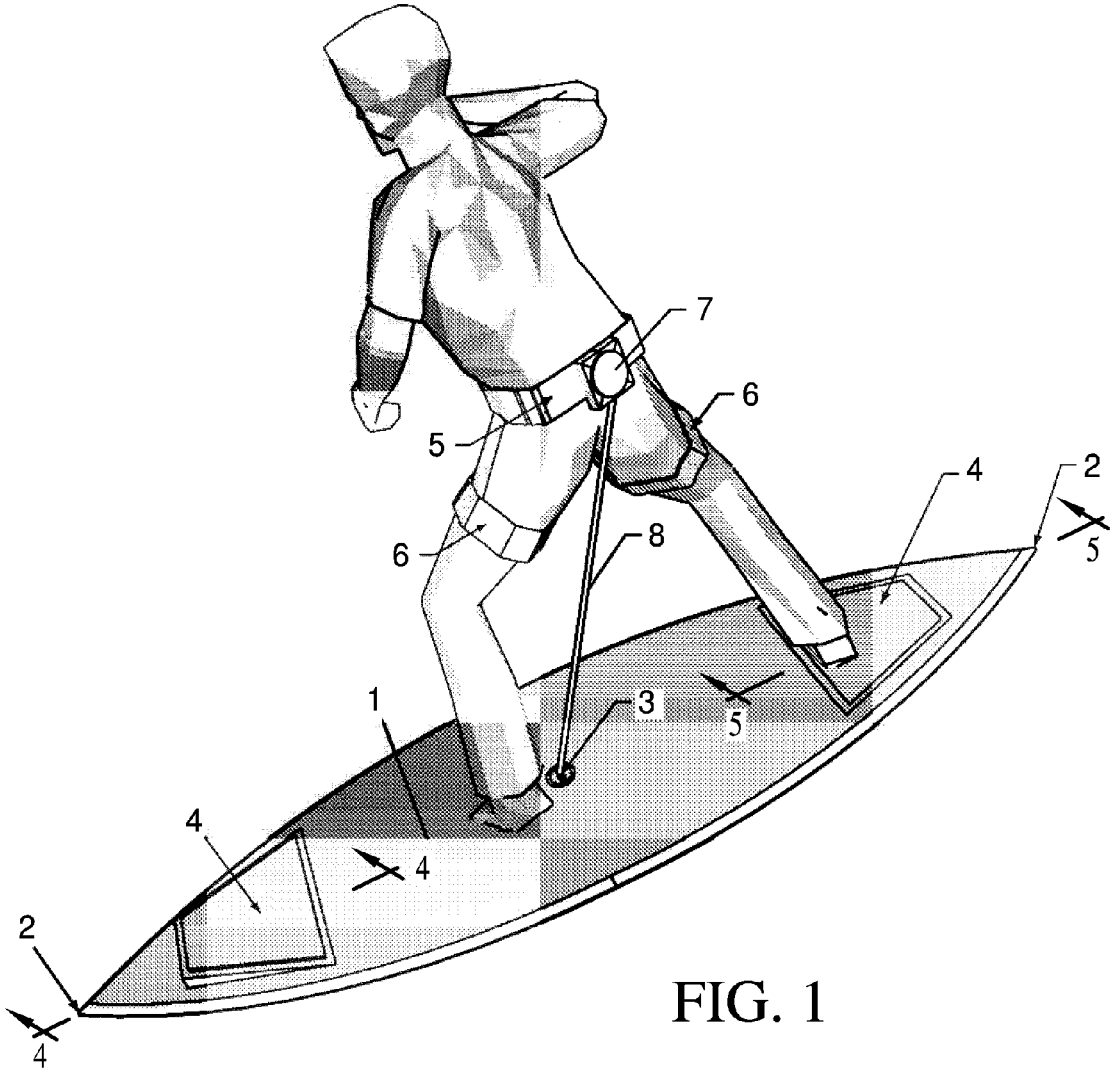
FIG. 1 is a perspective view of a symmetry surfboard in one exemplary use.
Figure 6:
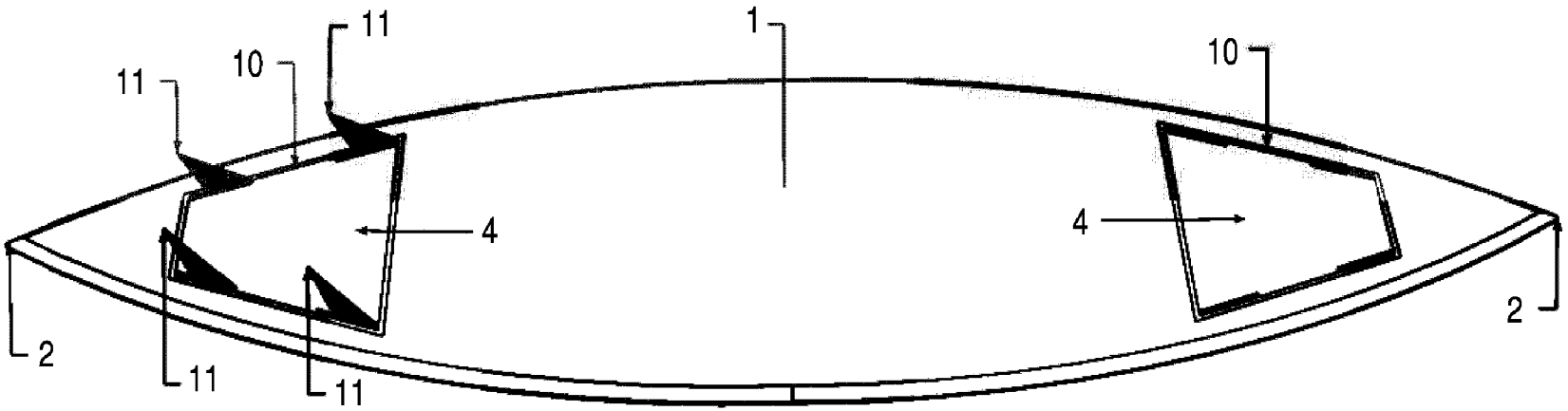
FIG. 6 is a bottom view of a symmetry surfboard system wherein one of two removable fin systems is illustrated with fins in an extended position.

FIG. 1 is a perspective view of the symmetry surfboard 1 in one exemplary use, wherein a surfer has activated one of two sets of fins 4 into the extended position and wherein the surfer is secured to the surfboard by the leash 8 fastened both to his harness 5 and to the surfboard 1. To further understand the exemplary use depicted in FIG. 1, reference is also made to FIG. 3 illustrating a removable fin system 4 with the pressure-activated footplate 9 down. When the pressure-activated footplate 9 is activated down, one or more fins 11 extend below the housing component 10. As will be understood with reference to FIG. 1, the pressure-activated footplate 9 is preferably configured for foot activation by the surfer. Further in this regard, FIG. 1 and FIG. 6 illustrate a surfboard 1 that has two similar ends 2. The surfboard 1 has sufficient buoyancy to support a surfer on top of water. In the center of surfboard 1 is a recessed space into which a connective device 3 is affixed. This is preferably a sturdy centered leash tie. Into each end 2 of surfboard 1 is placed, either during or after manufacture of surfboard 1, a removable fin system 4. FIG. 1 illustrates a surfer using a harness 12 with a waist attachment 5 and two leg attachments 6 to which is attached a self-winding reel with drag gear 7 into or from which a pliant leash 8 can extend to be attached to the recessed connective device 3 thus securing the surfer to the surfboard 1.

FIG. 2 and FIG. 3 illustrate, in isolation, a version of a removable fin system 4 with the pressure-activated footplate 9 which, when the removable fin system 4 is affixed within the surfboard 1, is nearly flush with the surface of surfboard 1. The housing component 10 of the removable fin system 4 will be attached within the surfboard 1 either during the manufacturing process, or afterwards in retrofit process. It will be understood from this description that its modular nature may also facilitate a process of removal and replacement if necessary. As more particularly shown in FIG. 2, the removable fin system may include a water-blocking skirt or apron 23 configured to prevent water entering the housing component 10 over the top surface of surfboard 1. This skirt 23 may comprise either a relatively rigid lamina or a durable, flexible, and waterproof synthetic material that may have accordion or bellows-type pleats. Alternatively, this skirt 23 may be formed of a heavier, elastomeric material patterned to act as a spring biasing to elevate the pressure-activated footplate 9 from housing component 10 and thus biasing to retract the fins 11.

FIG. 6 illustrates the bottom of surfboard 1 and depicts fins 11 extended below the bottom of surfboard 1 from within the housing component 10 of the removable fin system 4 at one symmetrical end 2 of surfboard 1; and at the other symmetrical end 2 of surfboard 1 depicts the removable fin system 4 with no fins 11 extended from within the housing module 10.

Figure 7:
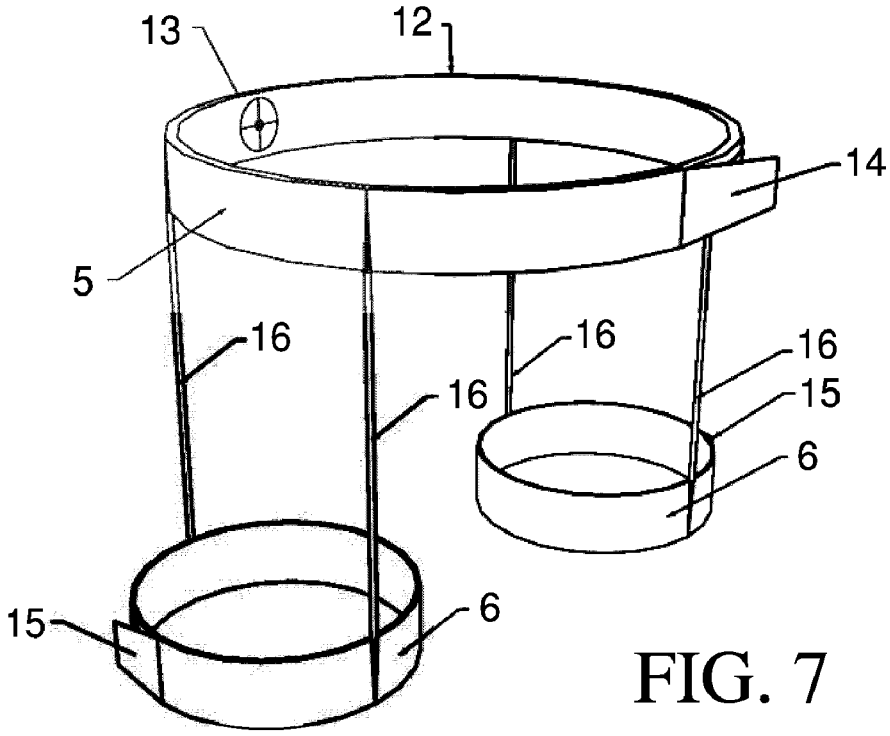
FIG. 7 is a right side elevational view of a harness by which a surfer may attach himself to a symmetry surfboard.

FIG. 7 depicts a harness 12, as shown having an apparatus 13 configured to attach the self-winding reel with drag gear 7 centered at the back of the waist attachment 5. FIG. 7 also shows a waist attachment closure device 14 configured to secure the harness 12 around the waist of a surfer. Further, FIG. 7 illustrates two leg attachments 6, two leg attachment closing devices 15, and straps 16 which connect the waist attachment 5 to the leg attachments 6. The closing devices 14,15 may include fabric-hook-and-loop type fasteners, snap, button, or buckle elements.

Figure 8:
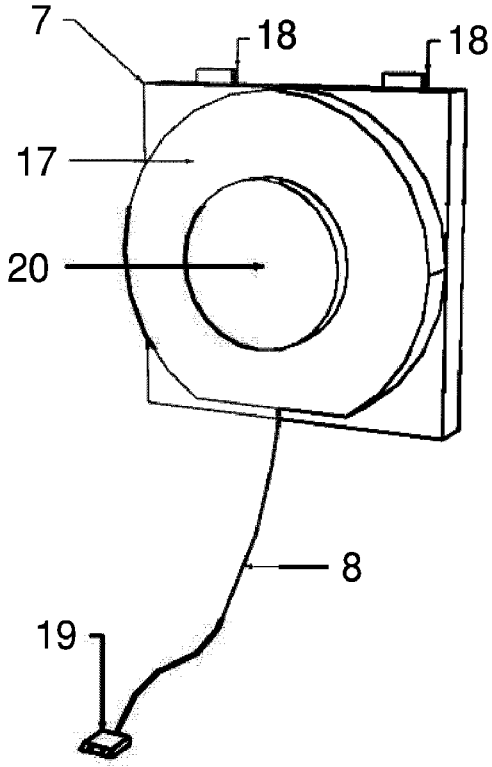
FIG. 8 is a front view of a self-winding reel with drag gear, a pliant leash, and a leash clip.

FIG. 8 illustrates the self-winding reel with drag gear 7 which is to be attached to the harness 12 waist attachment 5 by clips 18 at the apparatus 13 configured to attach the self-winding reel with drag gear 7; and which will contain a pliant leash 8 in a leash housing 17. The self-winding reel with drag gear 7 will provide the connection of a surfer on surfboard 1 to surfboard 1 at the recessed connective device 3 with a leash clip 19. The self-winding reel with drag gear 7 will have a self-activated lock and release mechanism 20.

A symmetric surfboard 1 that will operate in either direction requires that, if both ends 2 are either the same or similar, some controlling device or mechanism be affixed to or into both ends 2 of the surfboard that will permit surfer action, at any chosen time, to make one end 2 the front end, or nose, so that the surfboard 1 will go forward controlled by the other end 2 which becomes the operating back end 2, or tail. A fin system 4 affixed to or into both ends 2 will provide the control so as to allow for dual-directional function. The shape and number of fins 11 in such a system will imitate the tail, which is fixed and stable in a traditional surfboard, thus providing the capability to control and maneuver the surfboard 1. A connective device 3 for leash 8 attachment may preferably be affixed to a recessed space in the center of the top surface of the surfboard 1 thus providing the means of connecting the surfer to the surfboard.

Figure 4:
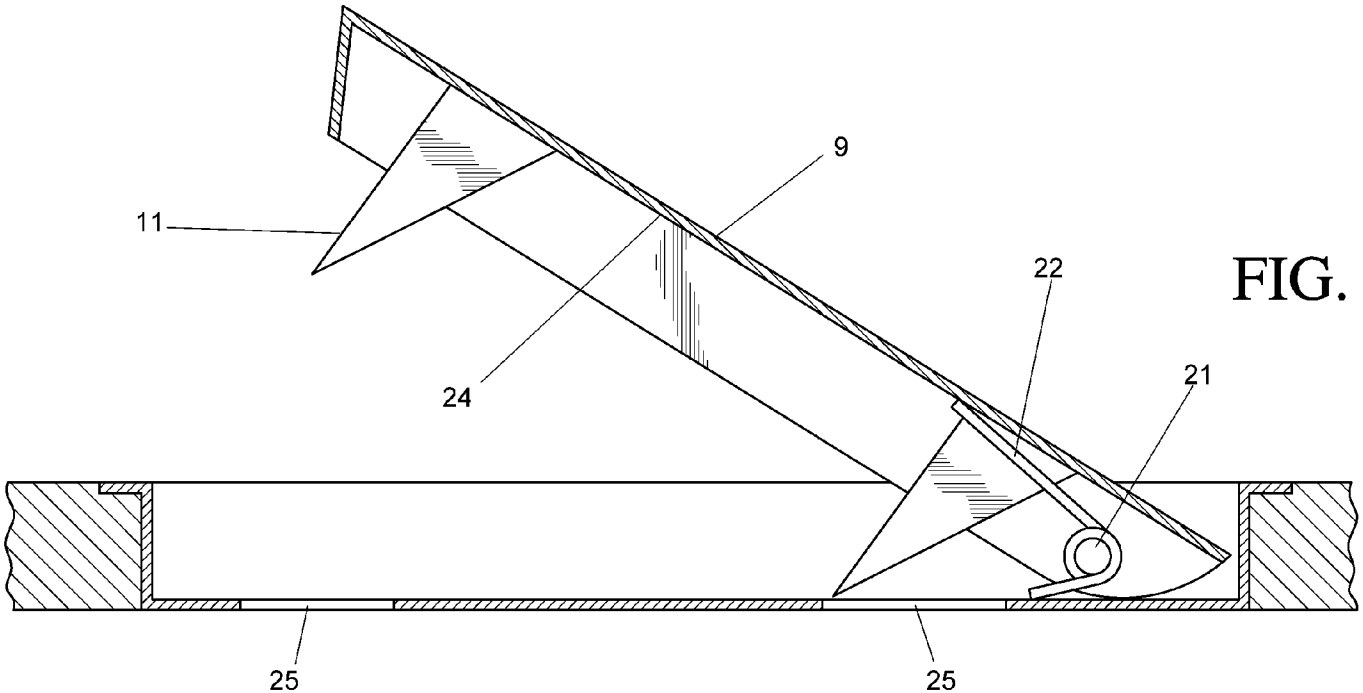
FIG. 4 is a side cutaway view of a version of the unactivated fin system installed in a surfboard.
Figure 5:
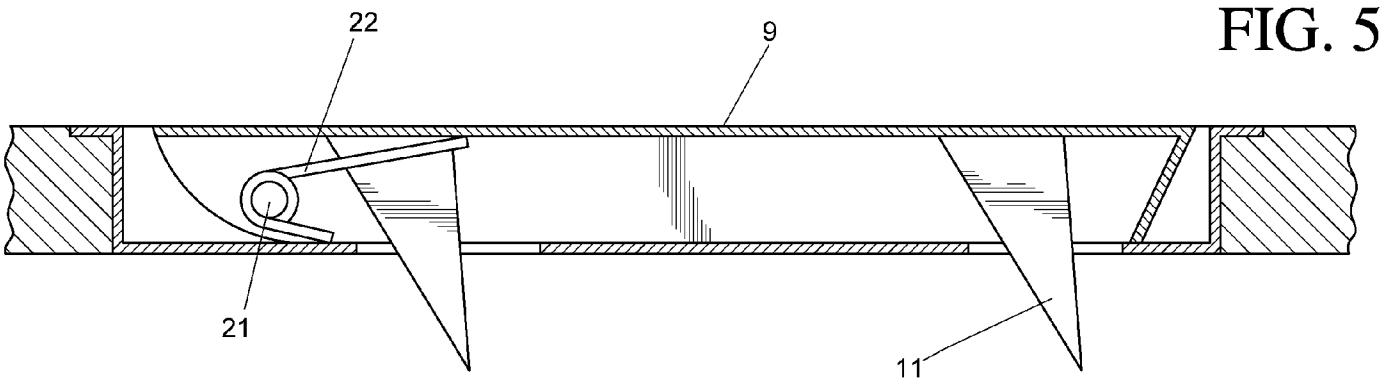
FIG. 5 is a side cutaway view of a version of the activated fin system installed in a surfboard.

With further reference to FIGS. 2-5 the fin system 4 may comprise a module 4 that has a foot plate 9 on the top surface of the surfboard, an internal housing component 10 within the body of the surfboard, and fins 11 within the internal housing component 10 that can extend from the bottom surface of the surfboard 1 as also depicted in FIG. 6. The fins 11 may be connected to an undersurface 24 of the footplate 9, as depicted in FIGS. 4-5. In one version, when no fins 11 are extended from the housing component 10 through cutouts 25, a surfer who steps onto the footplate 9 will cause the fins 11 to extend. When fins 11 are extended from the housing component 10 a surfer who steps off of the footplate 9 may cause the fins 11 to retract through cutouts 25 into the housing component 10. Although it is unlikely that a surfer will extend both sets of fins 11 into the water at the same time, doing so is an alternate embodiment. The fin system 4 can be manufactured as an integral part of the surfboard 1 or installed into cutouts in the surfboard 1 in a process after the surfboard has been manufactured. That the fin system 4 will be removable, whether installed during or after manufacture, will facilitate replacement of a damaged fin system 4 and also permits the choice of fins 11 of different sizes, shapes, tilt, rotation, and numbers without the cost of purchasing a new surfboard 1. Thus the size, shape, tilt, rotation, and number of fins 11 may vary to accommodate all potential surfers and surfing uses and will depend partly on a symmetric surfboard's shape and size and partly on what kind of surfing a surfer wants to do. Fin 11 design may vary in any manner that will enhance the control and handling capabilities of the surfboard 1 to include modifications to accommodate for the removal of the standard tail piece.

With further reference to FIGS. 2-5, it will be understood that in FIG. 4 and FIG. 5 the extension of the fins is illustrated via depictions of unactivated and activated fin systems. When the surfer exerts downward pressure to activate the footplate 9, the footplate rear edge settles into the fin housing 10. The leading edge of the footplate 9, that is the edge closest to the center of the symmetry surfboard, will then pivot along its pivot rod 21 which serves as a hinge. The pivot rod 21 preferably will run parallel to the leading edge and perpendicular to the surfboard stringer (the stringer being the center support line running from end to end of the surfboard). The downward pressure exerted by the user will compress a return spring 22 and extend the fins 11 through the bottom of the surfboard 1 into the wave, as shown in FIG. 5. Conversely, when pressure is released from the footplate 9 the return spring 22 will exert upward force on the foot plate 9. The footplate 9 will then move into the unactivated position as shown in FIG. 4 and lift the attached fins 11 out of the wave, or into the retracted position. It was noted previously in this description that as more particularly shown in FIG. 2, the removable fin system may include a water-blocking skirt or apron 23 configured to prevent water entering the housing component 10 over the top surface of surfboard 1. However, such skirt or apron 23 may be omitted, as depicted in FIGS. 4-5. When present, this skirt 23 may comprise either a relatively rigid lamina or a durable, flexible, and waterproof synthetic material that may have accordion or bellows-type pleats. Alternatively, this skirt 23 may be formed of a heavier, elastomeric material that itself acts as a spring biasing to elevate the pressure-activated footplate 9 from housing component 10 and thus biasing to retract the fins 11. In this second instance, a return spring 22 may or may not be included in the fin system 4.

As depicted in FIG. 1, FIG. 7, FIG. 8, a harness 12 worn while surfing will provide a mounting for the leash reel 7 and may be designed in a variety of ways and include additions such as padding and flotation. The leash reel 7 could be worn in the center back of the surf belt 12 or off to the left or right side of center back depending on surfer preference. However, because surfers paddle while lying prone on the top of a surfboard, a reel 7 will not be attached to the harness at a surfer's front thus eliminating discomfort to the surfer and damage to the surfboard's surface. The leash reel 7 would clip 18 to the belt 5 in a manner permitting its quick removal from the harness 12 thus separating the surfer from the surfboard 1 during emergencies. The placement of a leash 8 at a surfer's back or side will allow easier removal during emergency situations than that currently provided by conventional surfing where the leash is looped around a surfer's ankle. The harness 12 may be worn over either a wetsuit or dry suit that is not manufactured with belt loops, and may include detachable leg attachments 6 when using clothing equipped with the necessary belt loops. The leash reel 7 would then fit the harness 12 as stated above.

While a standard surfboard has a leash tie at its tail the purpose of which is to prevent a surfer from losing his surfboard, a centered 3 leash 8 according to the invention will not only prevent the loss of the surfboard 1 but will allow for a secure connection between a surfer and his surfboard 1, thus decreasing or removing a surfer's need to utilize hands to hold onto a surfboard 1 while performing tricks and maneuvers. The upward tension that will allow for a secure connection is accomplished by a surfer feeding out or reeling in, as applicable, the pliant leash 8, attached at one end 19 to the surfboard 1 and at the other end to a reel 7 affixed to his harness 12; and then locking the leash 8 at the desired length. When the leash 8 is locked, the surfer may extend downward pressure with his legs to the board making a three-point connection with the surfboard. This provides a firm attachment to the board that is not provided in traditional surf situations where an ankle-tether leash is always slack. The leash 8 of the present invention may preferably unlock by hand action to the leash reel 7.

Thus, as is understood with reference to the aforegoing description, the present invention requires only that the surfer pivot, applying or releasing pressure as applicable on footplates 9, 4 on the surfboard 1 surface to extend and retract fins 11 at one end 2 and extend and retract fins at the other end 2. The surfer's secure attachment to the surfboard 1 by a taut leash will facilitate such actions, making these actions possible for a surfer to perform while in a standing position.

Thus, when a surfer 'catches a wave' and stands up on the symmetrical surfboard 1, he may retract the leash 8 attached to his harness 12 in order to pull slack leash 8 from the water, thereby preventing frictional drag that a trailing leash would cause. This is in contrast to the traditional surf situations in which an ankle-tether leash only provides a way to keep from having to chase a surfboard after losing contact with it. With the symmetrical surfing system of the present invention a surfer may extend downward pressure on the surfboard 1 by bending his legs and then he may lock the leash, thus forming a secure connection of the surfer to the surfboard 1. This three-point connection (two surfer legs and a surfboard) with the symmetrical surfboard 1 will allow the surfer greater control of himself and his surfboard by providing a firm attachment to the board that is not provided in traditional surf situations where the leash is always slack. This connection will also remove the current necessity to squat and hold onto a surfboard by hand during tricks such as when launching off a wave and 'catching air.'

While various exemplary apparatus, systems, and processes have been illustrated in the accompanying drawings and described in the aforegoing detailed description it should be understood that the claims to the apparatus, systems, and processes shown and described are not limited to the particular embodiments described herein, as these may be capable of numerous rearrangements, modifications, and substitutions without departing from the scope and spirit of the claims set forth below. Consistent with legal precedent, the spirit and scope of the appended claims should not be limited to the description of the preferred versions contained herein. Accordingly, the techniques and structures described and illustrated herein should be understood to be illustrative only and not limiting upon the scope of the present invention. The scope of the present invention is defined by the appended claims, including known equivalents and unforeseeable equivalents at the time of filing of this application.

What is claimed is:

1. A symmetry surfing system comprising:
a board with two ends;
a first removable fin system located proximate a first of said ends;
said first removable fin system including a first pressure-activated footplate configured for foot activation;
said first removable fin system including at least one respective fin configured to be extended into the water by said first pressure-activated footplate;
a first spring biasing said first pressure-activated footplate upwards to an open position retracting said at least one respective fin;
a second removable fin system located proximate a second of said ends;
said second removable fin system including a second pressure-activated footplate configured for foot activation;
said second removable fin system including a second at least one respective fin configured to be extended into the water by said second pressure-activated footplate; and,
a second spring biasing said second pressure-activated footplate upwards to an open position retracting said second at least one respective fin.

2. A symmetry surfing system as claimed in claim 1, further comprising:
said first removable fin system including a water-blocking skirt.

3. A symmetry surfing system as claimed in claim 2, further comprising:
said second removable fin system including a second water-blocking skirt.

4. A symmetry surfing system as claimed in claim 1, further comprising:
a connective device in said board surface;
a leash;
a leash clip on an end of said leash; and,
said leash clip configured to attach to said connective device in said board surface.

5. A symmetry surfing system as claimed in claim 4, further comprising:
said connective device is affixed to the center of said board.

6. A symmetry surfing system as claimed in claim 4, further comprising:
a reel configured to wind said leash.

7. A symmetry surfing system as claimed in claim 6, further comprising:
a harness; and,
said reel being attached to said harness.

8. A symmetry surfing system as claimed in claim 7, further comprising:
said harness including a belt.

9. The symmetry surfing system as claimed in claim 8, wherein:
said reel is attached to said belt.

10. A symmetry surfing system as claimed in claim 8, further comprising:
said harness including at least one leg attachment portion.

11. A symmetry surfing system as claimed in claim 4, further comprising:

a harness;

a reel configured to wind said leash, said reel being attached to said harness;

said connective device being affixed to the center of said board and configured to support upward tension of said leash.

12. A symmetry surfing system as claimed in claim 1, further comprising:

a first pivot rod hinging said first pressure-activated footplate.

13. A symmetry surfing system as claimed in claim 12, further comprising:

a second pivot rod hinging said second pressure-activated foot plate.

14. A process for equipping a board with a removable fin system comprising:

establishing a cutout proximate an end of said board;

providing a housing component of the removable fin system in said cutout;

providing a pivot rod in the housing component;

providing a pressure-activated footplate configured to pivot around the pivot rod;

connecting at least one deployable fin to the pressure-activated footplate; and, providing a spring around the pivot rod to bias the pressure-activated footplate upwardly out of the housing component and to bias the deployable fin to an undeployed position.

15. A process for equipping a board with a removable fin system as claimed in claim 14, further comprising:

providing a water-blocking skirt between the housing component and the pressure-activated footplate.

16. A removable fin system comprising:

a housing component;

a pivot rod within said housing component;

a pressure-activated footplate hinged to said housing component via said pivot rod;

said pressure-activated footplate having an undersurface;

at least one fin connected to said undersurface;

at least one cutout in said housing component, said cutout configured to permit extension therethrough of said at least one fin; and, a spring configured to bias said pressure-activated footplate undersurface upwardly out of said housing component and said fin to an undeployed open position.

17. The removable find system as claimed in claim 16, wherein:

said spring is located around said pivot rod.

18. A removable fin system as claimed in claim 16, further comprising:

a water-blocking skirt between said housing component and said pressure-activated footplate.

19. A removable fin system as claimed in claim 16, further comprising:

a plurality of fins connected to said undersurface; and, a plurality of cutouts in said housing component, said cutouts configured to permit extension therethrough of said plurality of fins.

20. A surfboard with a fin system comprising:

a pressure-activated footplate configured for foot activation;

at least one fin configured to be extended into the water below the surfboard by said pressure-activated footplate; and, a spring biasing said pressure-activated footplate upwards to an open position retracting said at least one fin.

* * * * *